US011118775B2

(12) United States Patent
Cao et al.

(10) Patent No.: US 11,118,775 B2
(45) Date of Patent: Sep. 14, 2021

(54) LED LIGHT SOURCE

(71) Applicant: EPISTAR CORPORATION, Hsinchu (TW)

(72) Inventors: Densen Cao, Sandy, UT (US); Steven D Jensen, West Jordan, UT (US)

(73) Assignee: Epistar Corporation, Hsinchu (TW)

( * ) Notice: Subject to any disclaimer, the term of this patent is extended or adjusted under 35 U.S.C. 154(b) by 14 days.

(21) Appl. No.: 16/014,955

(22) Filed: Jun. 21, 2018

(65) Prior Publication Data

US 2018/0299112 A1 Oct. 18, 2018

Related U.S. Application Data

(63) Continuation of application No. 15/423,769, filed on Feb. 3, 2017, now Pat. No. 10,429,053, which is a (Continued)

(51) Int. Cl.
*F21V 29/70* (2015.01)
*F21V 29/85* (2015.01)

(Continued)

(52) U.S. Cl.
CPC ..... *F21V 29/70* (2015.01); *F21K 9/232* (2016.08); *F21K 9/235* (2016.08); *F21K 9/237* (2016.08); *F21K 9/90* (2013.01); *F21V 3/02* (2013.01); *F21V 29/503* (2015.01); *F21V 29/85* (2015.01); *F21V 29/86* (2015.01); *F21V 29/87* (2015.01); *H05B 33/10* (2013.01); *H05B 33/28* (2013.01);

(Continued)

(58) Field of Classification Search
CPC ..... F21K 9/232; F21K 9/235; F21K 9/237; F21K 9/90; F21V 29/503; F21V 29/70; F21V 29/85; F21V 29/86; F21V 29/87; F21V 3/02; F21Y 2107/40; F21Y 2115/10; H05B 33/10; H05B 33/28
See application file for complete search history.

(56) References Cited

U.S. PATENT DOCUMENTS 4,208,603 A * 6/1980 Graves ..... H01J 61/96 313/1
5,938,318 A 8/1999 Mattsen (Continued)

FOREIGN PATENT DOCUMENTS

CN 101506934 A 8/2009
CN 201526914 U 7/2010

(Continued)

*Primary Examiner* — Tsion Tumebo
(74) *Attorney, Agent, or Firm* — Ditthavong, Steiner & Mlotkowski

(57) ABSTRACT

A light source includes a socket connection, a base connected to the socket connection, an LED unit, a mount and a heat conductive material. The socket connection is capable of connecting to a source of electricity. The mount is disposed into the base, and has a top surface on which the LED unit are disposed and a side surface devoid of the LED unit. The heat conductive material directly contacts the LED unit and the side surface of the mount. The heat conductive material enters into a space flanked by the mount and the base and is substantially translucent or transparent such that light emitted from the LED unit is able to pass through the heat conductive material.

4 Claims, 4 Drawing Sheets

Related U.S. Application Data continuation of application No. 13/665,689, filed on Oct. 31, 2012, now abandoned.

(60) Provisional application No. 61/553,635, filed on Oct. 31, 2011.

(51) Int. Cl.

| | |
|---|---|
| ***F21K 9/232*** | (2016.01) |
| ***F21V 29/503*** | (2015.01) |
| ***F21K 9/235*** | (2016.01) |
| ***F21K 9/237*** | (2016.01) |
| ***F21K 9/90*** | (2016.01) |
| ***F21V 3/02*** | (2006.01) |
| ***F21Y 115/10*** | (2016.01) |
| ***F21V 29/87*** | (2015.01) |
| ***H05B 33/10*** | (2006.01) |
| ***H05B 33/28*** | (2006.01) |
| *F21Y 107/40* | (2016.01) |

(52) U.S. Cl.

CPC ..... *F21Y 2107/40* (2016.08); *F21Y 2115/10* (2016.08)

(56) References Cited

U.S. PATENT DOCUMENTS

| | | | | |
|---|---|---|---|---|
| 6,523,978 | B1 * | 2/2003 | Huang | F21V 3/00 313/500 |
| 6,741,029 | B2 | 5/2004 | Matsubara et al. | |
| 8,152,341 | B2 * | 4/2012 | Wheelock | F21V 29/58 362/373 |
| 8,227,962 | B1 * | 7/2012 | Su | F21K 9/232 313/46 |
| 8,450,927 | B2 | 5/2013 | Lenk et al. | |
| 8,653,723 | B2 * | 2/2014 | Cao | F21V 29/51 313/46 |
| 8,662,712 | B2 | 3/2014 | Kraus et al. | |
| 8,702,257 | B2 | 4/2014 | Lenk et al. | |
| 8,786,193 | B2 * | 7/2014 | Hsin | F21V 29/58 315/113 |
| 8,845,137 | B2 | 9/2014 | Van De Ven et al. | |
| 8,931,933 | B2 | 1/2015 | Tong et al. | |
| 9,273,830 | B2 | 3/2016 | Negley et al. | |
| D786,458 | S * | 5/2017 | Wang | D26/1 |
| 10,267,460 | B2 * | 4/2019 | Wu | F21K 9/238 |
| 2002/0114169 | A1 | 8/2002 | Harada et al. | |
| 2004/0008525 | A1 * | 1/2004 | Shibata | F21K 9/232 313/271 |
| 2006/0092640 | A1 | 5/2006 | Li | |
| 2006/0193130 | A1 * | 8/2006 | Ishibashi | F21V 29/67 362/227 |
| 2007/0267976 | A1 | 11/2007 | Bohler et al. | |
| 2008/0013316 | A1 | 1/2008 | Chiang | |
| 2008/0048200 | A1 | 2/2008 | Mueller et al. | |
| 2008/0062703 | A1 * | 3/2008 | Cao | F21K 9/232 362/311.06 |
| 2008/0285279 | A1 * | 11/2008 | Ng | F21V 3/02 362/249.01 |
| 2009/0086492 | A1 | 4/2009 | Meyer | |
| 2009/0175041 | A1 | 7/2009 | Yuen et al. | |
| 2009/0257220 | A1 | 10/2009 | Lenk et al. | |
| 2009/0283779 | A1 | 11/2009 | Negley et al. | |
| 2010/0103678 | A1 | 4/2010 | Van De Ven et al. | |
| 2010/0213479 | A1 | 8/2010 | Li et al. | |
| 2010/0244650 | A1 | 9/2010 | Osawa et al. | |
| 2010/0271836 | A1 | 10/2010 | Bakk | |
| 2010/0283369 | A1 | 11/2010 | Chen | |
| 2011/0193479 | A1 | 8/2011 | Nilssen et al. | |
| 2011/0211351 | A1 | 9/2011 | Van De Ven et al. | |
| 2012/0134158 | A1 | 5/2012 | Yang et al. | |
| 2015/0255440 | A1 * | 9/2015 | Hsieh | H01L 25/0753 257/88 |

FOREIGN PATENT DOCUMENTS

| | | | |
|---|---|---|---|
| CN | 201954296 | U | 8/2011 |
| EP | 2302284 | A2 | 3/2011 |
| JP | 2010108768 | A | 5/2010 |
| JP | 2011090843 | A | 5/2011 |
| KR | 20090002454 | U | 3/2009 |
| WO | 2006001032 | A2 | 1/2006 |
| WO | 2006001032 | A3 | 3/2006 |

* cited by examiner

LED LIGHT SOURCE

RELATED APPLICATION

This application is a continuation application of U.S. patent application of Ser. No. 15/423,769, filed on Feb. 3, 2017, which is is a continuation application of U.S. patent application of Ser. No. 13/665,689, filed on Oct. 31, 2012, which is a non-provisional of U.S. Application No. 61/553,635, filed on Oct. 31, 2011, and the contents of which are incorporated herein by reference in their entireties.

BACKGROUND

Technical Field

The present disclosure generally relates to light sources, and in particular, LED light sources

Description of the Related Art

Due to environmental and energy efficiency concerns, the lighting industry is in a current state of flux and working hard to develop a more efficient, yet equal quality, light source to replace traditional incandescent light sources. Traditional incandescent light sources are able to produce high lumen output, to which consumers have grown accustom. However, incandescent light sources generally suffer from poor power efficiency and short life span.

Several alternative light sources have been introduced in an effort to solve the energy efficiency and life span issues presented by traditional incandescent light sources. An example of an alternative light source is LED light sources. LED light sources have the potential to solve the energy efficiency and life span issues associated with incandescent light sources, but for more the most part, to date LED light sources have failed to replace incandescent light sources for the majority of the lighting market.

There are a variety of reasons why LED light sources have failed to effectively replace incandescent light sources. For example, one reason that LED light sources have not reached their potential is because LED light sources have strict heat management requirements. In particular, in order for LEDs to work efficiently, the heat generated by the LED itself must be managed very efficiently such that the operating temperature of the LED is minimized. If the LED is allowed to overheat, or run at too high of operating temperature, then the light output from the LED significantly decreases. In addition, if the LED overheats, then the life span and quality of light output decreases. Thus, light source developers have worked tirelessly at trying to develop heat management systems in LED light sources that are able to efficiently manage the heat produced by the LED.

The conventional method of managing the heat generated by the LEDs in an LED light source includes the use of a heat sink. In particular, the LEDs are typically mounted to one or more heat sinks that are designed to pull the heat away from the LEDs. An example heat sink structure may include an LED mounted to a primary structure that is responsible for transferring heat directly away from the LED. The primary structure is then mounted to a secondary structure that transfers the heat from the primary structure and eventually out of the light source structure itself.

The heat sinks in conventional LED light sources can include a relatively large finned-type structure that is located between the LEDs and the base (socket) of the light source. The heat sinks are conventionally made from metal, composite, or a similar material with good heat conduction properties. The size and type of materials used to create the heat sinks in conventional LED light sources create several disadvantages.

First, the size of the heat sinks in conventional LED lights sources may create a problem in that many LED light sources do not match the form factor of traditional incandescent bulbs. There are literally billions of light sockets installed worldwide, and any replacement light source to incandescent bulbs must have close to the same form factor as a standardized incandescent bulb. Due to the heat management requirements of LED light sources, the heat sinks are often relatively large, and therefore, many LED light sources do not have the same form factor as the traditional incandescent equivalent.

Second, at least partly due to the large amounts of metal used to create the heat sink structure in conventional LED light sources, the cost per LED light source is very high compared to an incandescent bulb. For example, at the time of filing this application a typical LED light source sold in home improvement retail centers cost about between ten to twenty times the cost of an incandescent bulb. The cost associated with manufacturing the heat sinks has stifled the ability of conventional LED light sources to become an affordable replacement option for the majority of consumers.

Third, the heat sink structures associated with conventional LED light sources produce a light source that has a poor aesthetic appearance. In essence, many conventional LED light sources look more like a machine than a decorative light source. Many consumers will not accept installing these types of LED light sources in light fixtures where the light source is visible due to the poor aesthetic appearance of conventional LED light sources.

In addition to all of the above disadvantages of heat sink structures in conventional LED light sources, most of the conventional heat sink structures are still unable to effectively manage the heat produced by the LEDs to allow a 60 W, 75 W or 100 W equivalent light source to be produced from an LED light source. Despite the bulky and expensive heat sink structures used on conventional heat sources, the light output of the LEDs are still not maximized because the LEDs will overheat, causing a loss in light output, shorter life span, and poor quality of light.

Accordingly, there is a need for a better heat management structure for LED light sources that maximizes the heat transfer away from the LEDs, fits traditional light socket form factors, costs less than conventional metal heat sink structures, and produces an aesthetically pleasing light source.

SUMMARY OF THE DISCLOSURE

A light source includes a socket connection, a base connected to the socket connection, an LED unit, a mount and a heat conductive material. The socket connection is capable of connecting to a source of electricity. The mount is disposed into the base, and has a top surface on which the LED unit are disposed and a side surface devoid of the LED unit. The heat conductive material directly contacts the LED unit and the side surface of the mount. The heat conductive material enters into a space flanked by the mount and the base and is substantially translucent or transparent such that light emitted from the LED unit is able to pass through the heat conductive material.

BRIEF DESCRIPTION OF THE DRAWINGS

In order to describe the manner in which the above-recited and other advantages and features of the invention can be obtained, a more particular description of the invention briefly described above will be rendered by reference to specific example embodiments thereof which are illustrated in the appended drawings. Understanding that these drawings depict only typical implementations of the invention and are not therefore to be considered to be limiting of its scope, the invention will be described and explained with additional specificity and detail through the use of the accompanying drawings.

DETAILED DESCRIPTION OF THE INVENTION

Figure 1A:
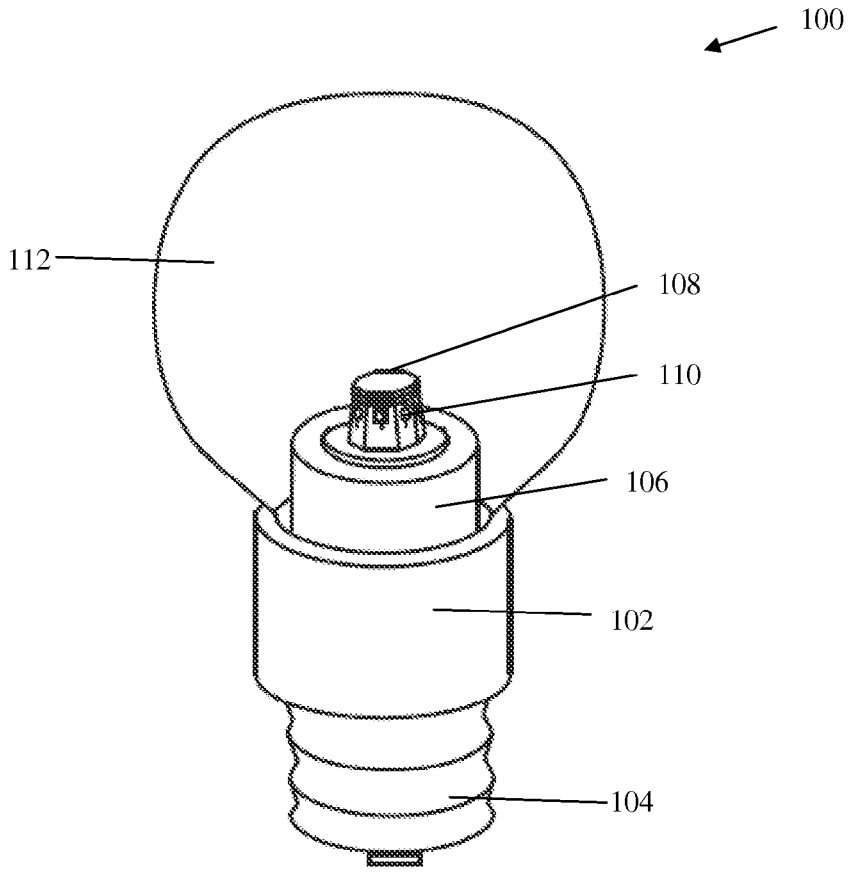
FIG. 1A illustrates an example light source.

Example embodiments of the present invention provide a LED light source with an effective and efficient heat management system. For example, embodiments of the present invention include devices, systems, materials, and methods to effectively transfer heat away from LEDs used in an LED light source to produce an LED light source that has high lumen output compared to conventional LED light sources. In particular, example embodiments of the present invention provide an LED light source that includes a transparent or translucent heat conductive material in which the LEDs are embedded. The heat conductive material has properties, such as heat conductivity, heat capacity, mass, position with respect to the LEDs, and other relevant properties, that allow light output from the LEDs to be maximized without the need to use a conventional heat sink structure.

For example, the heat conductive material can be molded and formed to be in the shape of a traditional incandescent form factor, or in other words, the heat conductive material in which the LEDs are embedded can be molded into the shape of the enclosure of a traditional incandescent light bulb. Because the heat conductive material is translucent or transparent, the LEDs can be embedded directly into the heat conductive material such that light produced from the LEDs can efficiently pass through the heat conductive material to produce a quality light source. Therefore, the heat conductive material itself can take the place of the traditional glass enclosure of an incandescent bulb, allowing the form factor of traditional incandescent bulbs to be almost exactly matched, if desired.

In addition, because the heat conductive material has the necessary properties to effectively manage the heat produced from the LEDs, there is no longer a need for the LED light source to have the conventional heat sink structure. The heat conductive material provides the necessary heat management by providing a large heat sink that completely surrounds the LEDs. Thus, without the need for the conventional heat sink structure, the present invention can drastically reduce the cost to produce a LED light source compared to conventional LED light sources.

Moreover, because the conventional heat sink structure is no longer needed, embodiments of the present invention provide an LED light source that is aesthetically pleasing. In essence, the present invention allows and LED light source to truly replace a decorative incandescent light source since the LED light source can produce the necessary light output, and at the same time remain in a form factor that does not require bulky and machine-type looking aesthetics that are caused by conventional heat sink structures.

In addition to the above advantages of the present invention, the heat conductive material in which the LEDs are embedded provides a more efficient way to manage the heat produced by the LEDs compared to conventional heat sink structures. Due to the more efficient management of heat, the LEDs can be run at higher energy levels so as to produce more light output. The increase in light output from the LEDs provided by embodiments of the present invention allows for an LED light source that can match the light output of a traditional incandescent light bulb.

The above and additional advantages of the present invention will be discussed further with respect to the Figures. One example embodiment of the present invention is illustrated in FIG. 1A. FIG. 1A illustrates an example LED light source 100. The LED light source can include a base portion 102. The base portion 102 can be made from metal, ceramic, or other suitable material. In one embodiment, the base can be made of a material that includes heat transfer properties such that the heat conducted through the heat conductive material (explained further below) can be effectively transferred into the base portion 102.

As illustrated in FIG. 1A, the base portion 102 has a circular geometric configuration that matches a traditional incandescent light bulb form factor. In alternative embodiments, the base portion 102 can have any geometric configuration that is desired for any particular application. The base portion 102 can be used to house electronics (e.g., circuit boards, voltage controllers/converters, etc.) (not shown) that may be necessary to condition the electrical current that may be required by the LEDs. Depending on the configuration, the light source 100 may or may not include electronics.

As illustrated in FIG. 1A, the base portion 102 can include a socket connection 104. The socket connection 104 illustrated in FIG. 1A is a standard light bulb connection that would be used in standard Edison type sockets. In alternative embodiments, and depending on the type of light source required, the socket connection can be any connection that is known in the industry, or that may be introduced to the industry. Example socket connections include, but are not limited to, bi-pin, wafer, bayonet, and different sized of Edison screw type socket connections 104. In at least one example embodiment, the base portion 102 only includes a socket connection 104, substantially similar to a conventional incandescent light bulb configuration.

The socket connection 104 provides an electrical connection to the LED unit 108. The LED unit may be connected to the base portion 102 by way of a mount 106, although the mount is not necessary and is shown only by way of example structure that may be implemented to create the light source 100. The LED unit 108 can include one or more LEDs 110. For example, and as illustrated in FIG. 1A, the LED unit 108 provides a structure such that a plurality of LEDs 110 can be mounted in a three hundred and sixty degree orientation.

In alternative embodiments, the LED unit 108 can have almost any configuration. For example, the LED unit 108 can direct the light emitted from the LEDs 110 in one or more directions, and thus have a structure that corresponds accordingly. The LED unit 108 structure and configuration is not a limiting factor of the present invention, but rather any LED unit 108 structure that is known in the industry can be implemented in the present invention. In addition, the present invention can provide for an example LED unit 108 wherein the LED unit 108 does not have a mounting structure to which the LEDs 110 are mounted. This embodiment will be explained further below with reference to FIG. 2.

Arranged over the top of the LED unit 108, the light source 100 includes a heat conductive material 112 in which the LED unit 108 is embedded. The mount 106 (if included) may also be embedded in the heat conductive material 112, as illustrated in FIG. 1A. For example, the heat conductive material 112 can affix or attach to the base and/or mount by positioning a portion of the heat conductive material 112 between the space flanked by the mount 106 and base portion 102 such that the heat conductive material 112 is secured in place. In addition, for example, portions of the base 102 may also be embedded in the heat conductive material 112.

Figure 1B:
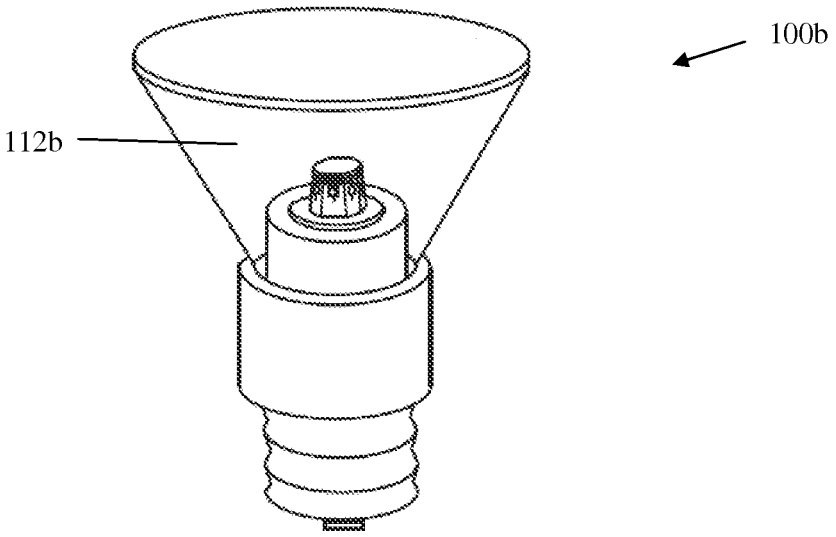
FIG. 1B illustrates an example light source.
Figure 1C:
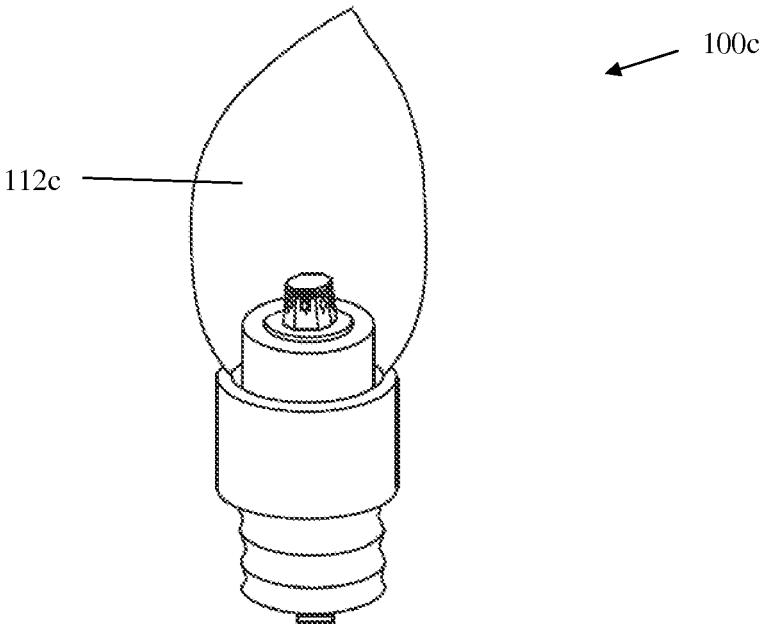
FIG. 1C illustrates an example light source.

As illustrated in FIG. 1A, the heat conductive material 112 can be molded and shaped into a traditional incandescent light bulb form factor. FIGS. 1B and 1C illustrate additional examples of a light source 100*b* and 100*c* in which the heat conductive material 112*b* and 112*c*, respectively, is formed in various other standard light bulb form factors. In addition to the examples shown in FIGS. 1A through 1C, the heat conductive material can be used to form any type and shape of light bulb, including those standards that are already accepted, as well as custom types and shapes. For example, the heat conductive material 112 can be molded to produce form factors that match A19, A14, T8, T4, T3, MR8, MR11, MR16, PAR (parabolic reflector), R (reflector) and any other standardized bulb form factor.

The heat conductive material 112 is a material that is sufficiently translucent or transparent such that at least a portion of the light emitted from the LEDs 110 can pass through the material. Moreover, the heat conductive material 112 has sufficiently high heat transfer properties to allow the heat produced from the LEDs 110 to be efficiently and effectively moved away from the LEDs 110 and transferred to and through the heat conductive material 112 to allow the LEDs 110 to have a sufficiently low operating temperature to maintain light output performance.

In addition to the above properties, the heat conductive material 112 can range from a high viscosity liquid (such as heavy grease) to a solid. In some examples, the heat conductive material 112 can have a rubber type consistency that allows the light source 100 to be dropped without breaking or chipping the heat conductive material 112.

Depending on the form in which the heat conductive material 112 takes, the light source 100 can include an enclosure (not shown) that encloses the material. For example, an enclosure may be used to contain and shape a heavy grease type heat conductive material. As illustrated in FIG. 1A, however, it is not necessary that the light source 100 include an enclosure when the heat conductive material 112 has physical properties that maintain the shape of the heat conductive material 112 around the LED unit 108.

Example materials that may be used for the heat conductive material include, but are not limited to, clear silicone-based polymers, long chain alkanes, solid transparent waxes, transparent ceramic materials, or any like material that has sufficient heat transfer properties coupled with sufficient translucency or transparency.

Various other materials, for example, thermoplastics that are used in injection mold applications, can also be used. The thermoplastic materials that can be used include, but are not limited to, ethylene-vinyl acetate polymers and copolymers, polycaprolactone polymers and co-polymers, polyolefin polymers, amorphous polyolefin polymers and copolymers, such as low density polyethylene or polypropylene, atactic polypropylene, oxidized polyethylene, and polybutene-1; ethylene acrylate polymers and copolymers, such as ethylene-vinylacetate-maleic anhydride, ethyleneacrylate-maleic anhydride terpolymers like ethylene n-butyl acrylate, ethylene acrylic acid, ethylene-ethyl acetate; polyamide polymers and copolymers, polyester polymers and copolymers, polyurethane polymers and copolymers, Styrene polymers and copolymers, polycarbonate polymers and copolymers, silicone rubber polymers and copolymers, polysaccharide polymers and copolymers, fluoropolymers, polypyrrole polymers, polycarbonate polymers and copolymers, waxy polymers and copolymers, waxes, copolyvidones (copovidones), polyacrylic acid polymers and copolymers, polymaleic acid polymers and copolymers, polyimides, polyvinyl chloride polymers and copolymers, poly(ethylene-comethacrylic acid) copolymers, and any other useful plastics, polymers and copolymers, and/or any combination thereof.

Plastics can be a thermoplastic or a thermoset plastic. These polymers can be comprised of straight chain, copolymeric, block or any combination of polymers incorporated into the same mass. Plastics can be chosen from the group of polymers such as: polyacrylates, polyamide-imide, phenolic, nylon, nitrile resins, fluoropolymers, copolyvidones (copovidones), epoxy, melamine-formaldehyde, diallyl phthalate, acetal, coumarone-indene, acrylics, acrylonitrile-butadiene-styrene, alkyds, cellulosics, polybutylene, polycarbonate, polycaprolactones, polyethylene, polyimides, polyphenylene oxide, polypropylene, polystyrene, polyurethanes, polyvinyl acetates, polyvinyl chloride, poly (vinyl alcohol-co ethylene), styrene acrylonitrile, sulfone polymers, saturated or unsaturated polyesters, urea-formaldehyde, or any like or useful plastics.

Additional example materials include, polyacrylates, polyamide-imide, phenolic, nylon, nitrile resins, petroleum resins, fluoropolymers, copolyvidones (copovidones), epoxy, melamine-formaldehyde, diallyl phthalate, acetal, coumarone-indene, acrylics, acrylonitrile-butadiene-styrene, alkyds, cellulosics, polybutylene, polycarbonate, polycaprolactones, polyethylene, polyimides, polyphenylene oxide, polypropylene, polystyrene, polyurethanes, polyvinyl acetates, polyvinyl chloride, poly(vinyl alcohol-co ethylene), styrene acrylonitrile, sulfone polymers, saturated or unsaturated polyesters, urea-formaldehyde, or any like plastics.

In addition, the heat conductive material can be combined with a light converting material, such as phosphor, such that the light emitted from the LEDs 110 can be manipulated by passing through the heat conductive material. For example, phosphor material can be integrated with a polymer based material such that if the LEDs 110 emit blue light, the phosphor material converts the blue light to substantially white light upon the blue light passing through the heat conductive material.

As illustrated in FIG. 1, the heat conductive material 112 can be in direct contact with the LEDs 110, the LED unit 108, and if included, the mount 106. As briefly discussed above, in conventional LED light sources, the LEDs on are in contact on one side with the LED unit 108 (or similar structure). Thus, the design in conventional LED light sources is implemented to direct all the heat generated from the LEDs down through the LED unit 108 (or similar structure) and down to a larger heat sink. The present invention, however, allows the heat generated by the LEDs 110 to not only be transferred to LED unit 108, but also to be directly transferred to the heat conductive material 112. This allows for a magnitude more of additional heat transfer compared to conventional LED light sources, which in turn allows the LEDs 110 to be run at higher light output levels, and thus produce an LED light source 100 that can be an effective replacement to incandescent light bulbs.

Figure 2:
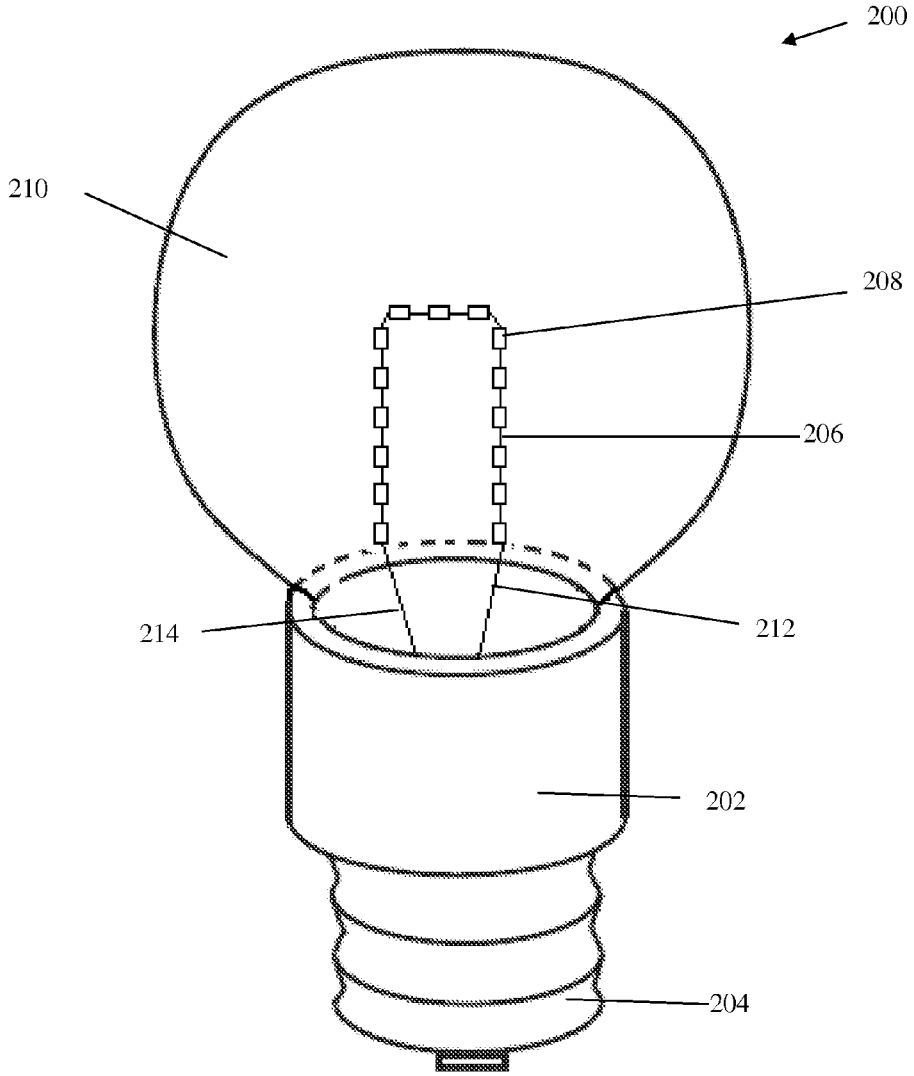
FIG. 2 illustrates a light source with an example LED configuration.

Because the heat generated by the LEDs can effectively be transferred to and through the heat conductive material 112, there is not necessarily a need for heat sink type structures, such as mounts 106, LED units 108 or similar type structures. For example, FIG. 2 illustrates an example embodiment of a light source 200 that does not include any conventional type heat sink structures. The light source 200 includes a base portion 202 and a socket connection 204, similar to the structures described with reference to FIG. 1A.

In addition, light source 200 includes an LED element 206 that includes one or more LEDs 208. For example, as illustrated in FIG. 2, the LED element includes a plurality of LEDs 208 in a stringed configuration. Due to the fact that each of the LEDs 208 are completely embedded within the heat conductive material 210, the heat produced by the LEDs 208 is effectively and efficiently moved away from the LEDs 208 by the heat conductive material 210 without the need for any additional heat sink structure.

FIG. 2 only shows one example of an LED element 206. As illustrated in FIG. 2, the LED element 206 includes a positive electrical connection 212 and a negative electrical connection 214. Each LED 208 is then connected in series to produce a functioning LED element 206 with a plurality of LEDs 208. In alternative embodiments, the LEDs 208 can be connected in parallel. In addition, the LED element 206 illustrated in FIG. 2 has an upside-down-"U" shaped configuration. In alternative embodiments, the LED element 206 can have almost any configuration such that the LEDs 208 can be arranged almost anywhere within the heat conductive material 210.

In one example embodiment, the LED element only includes a single LED. In another example, the LED element includes an LED array. In yet another example embodiment, the light source 200 can include a plurality of LED elements 206.

Figure 3:
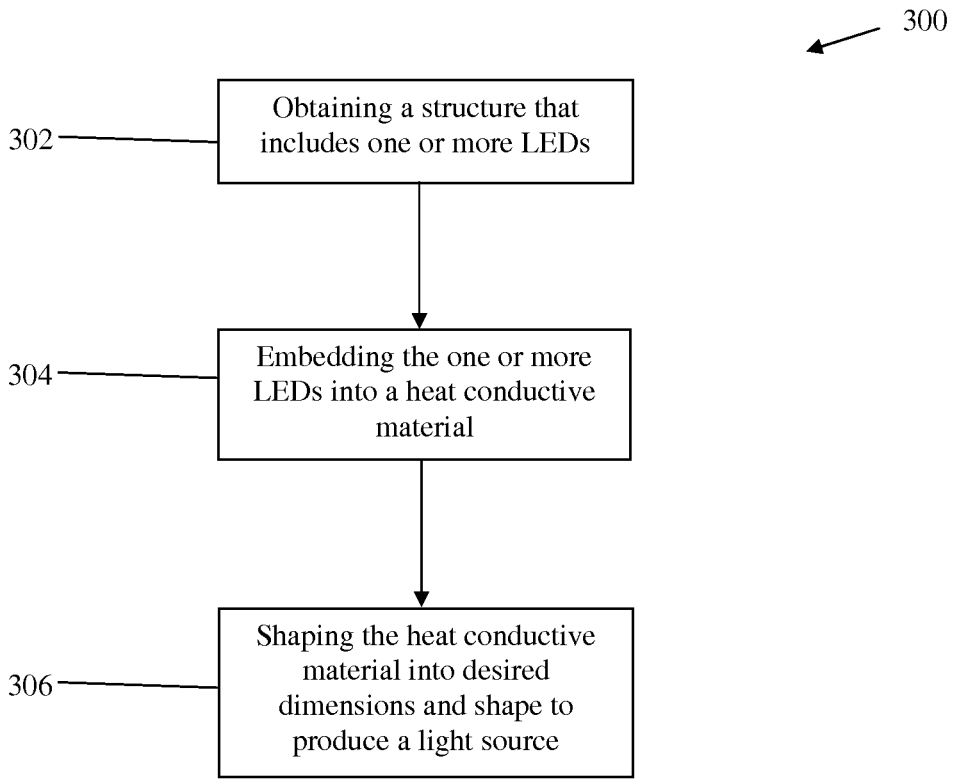
FIG. 3 illustrates an example method of making a LED light source.

Accordingly, FIGS. 1A through 2 and the corresponding text provide a number of different components, devices and teachings that provide a LED light source. In addition to the foregoing, example embodiments of the present invention can also be described in terms of flowcharts comprising one or more acts in a method for accomplishing a particular result. For example, FIG. 3 illustrates a method 300 of making an LED light source. The acts of FIG. 3 are discussed more fully below with respect to the components discussed with reference to FIGS. 1A through FIG. 2.

For example, FIG. 3 shows that the method 300 comprises an act 302 of obtaining a structure that includes one or more LEDs. For example, FIG. 1A shows that the structure that includes one or more LEDs can include a LED unit 108. In another example, the structure that includes one or more LEDs can include a LED element 206, as discussed with reference to FIG. 2A.

Also, the method 300 comprises an act 304 of embedding the one or more LEDs into a heat conductive material. For example, FIG. 1A illustrates that the LED unit 108 is embedded into the heat conductive material 112. In another example shown in FIG. 2, the LED element 206 is embedded into the heat conductive material 210. For example, the heat conductive material can be in an uncured state (e.g., moldable state) that allows the structure that includes one or more LEDs to be embedded into the heat conductive material. After the structure is embedded within the material, the heat conductive material can be transformed to an uncured state (e.g., solid state) that secures the structure within the heat conductive material. The curing process can be performed by way of temperature cure, light cure, chemical cure, or any other similar type of mechanism. Moreover, a curing process does not have to take place if an enclosure is used to contain the heat conductive material into which the LEDs are embedded.

In addition, the method 300 comprises an act 306 of shaping the heat conductive material into desired dimensions and shape to produce a light source. For example, FIGS. 1A through 1C illustrate that the heat conductive material can be shaped and dimensioned to form various standard sizes of light sources, such as an A19, candelabra, etc. In additional, the heat conductive material can be shaped and dimensioned to form various custom sizes of light sources.

Accordingly, the diagrams and figures provided in FIG. 1A through FIG. 3 illustrate a number of methods, devices, systems, configurations, and components that can be used to produce a LED light source.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A light source, comprising:

a socket connection configured for connection to a source of electricity;

a base arranged on the socket connection without being laterally covered by the socket connection, and having a width greater than that of the socket connection;

a heat conductive structure having a heat conductive material affixed to the base; and an LED element directly and fully embedded in the heat conductive material while the heat conductive material is an uncured state and subsequently cured to secure the LED element within the heat conductive material, and comprising a positive electrical connection, a negative electrical connection, and a plurality of LEDs, wherein the plurality of LEDs is connected to each other through a plurality of wires, and has a curved configuration constrained by the plurality of wires and the heat conductive structure having the heat conductive material, and wherein each of the plurality of LEDs does not include a heat sink, and is not mounted to a mounting structure.

2. The light source of claim 1, wherein the plurality of LEDs is connected in series between the positive electrical connection and the negative electrical connection.

3. The light source of claim 1, wherein the plurality of LEDs is connected in parallel between the positive electrical connection and the negative electrical connection.

4. The light source of claim 1, wherein the curved configuration has an upside-down-"U" shape.

* * * * *